US006614146B2

(12) United States Patent
Cleary et al.

(10) Patent No.: US 6,614,146 B2
(45) Date of Patent: Sep. 2, 2003

(54) ELECTRODE SHIELD FOR FLUORESCENT LAMP HAVING A PAIR OF SPACED APART SHIELD PLATES

(75) Inventors: Louise Cleary, Salem, MA (US); Joseph V. Lima, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 81 days.

(21) Appl. No.: 09/961,467

(22) Filed: Sep. 24, 2001

(65) Prior Publication Data

US 2003/0057817 A1 Mar. 27, 2003

(51) Int. Cl.[7] ..... H01J 61/04; H01J 1/52
(52) U.S. Cl. ..... 313/242; 313/613; 313/580
(58) Field of Search ..... 313/238, 239, 313/242, 580, 613, 614, 616, 492

(56) References Cited

U.S. PATENT DOCUMENTS 1,928,202 A * 9/1933 Meyer et al. ..... 313/590
2,824,255 A * 2/1958 Mlstler ..... 313/613
3,069,581 A * 12/1962 Lemmers ..... 313/576
3,121,184 A 2/1964 Fox ..... 313/207
5,004,949 A * 4/1991 Latassa et al. ..... 313/492
6,049,164 A * 4/2000 Van Kemenade et al. .. 313/492
6,445,121 B1 * 9/2002 Roes et al. ..... 313/492
6,498,432 B1 * 12/2002 Vossen et al. ..... 313/613

FOREIGN PATENT DOCUMENTS

GB 2147735 A * 5/1985 ..... H01J/61/04

* cited by examiner

*Primary Examiner*—Nimeshkumar D. Patel
*Assistant Examiner*—Karabi Guharay
(74) *Attorney, Agent, or Firm*—Carlo S. Bessone

(57) ABSTRACT

A mount for a fluorescent lamp has a glass base, a longitudinal electrode coil mounted upon lead-in wires extending from the base, and a shield mounted upon the base. The shield comprises a pair of spaced apart shield plates, one on either side of the electrode coil and spaced therefrom.

4 Claims, 3 Drawing Sheets

ELECTRODE SHIELD FOR FLUORESCENT LAMP HAVING A PAIR OF SPACED APART SHIELD PLATES

TECHNICAL FIELD

This invention relates to fluorescent lamps and more particularly to a shield for the electron source of such lamps.

BACKGROUND ART

Fluorescent lamps are energy efficient light sources. An arc discharge occurring in the lamp generates actinic radiation, which causes fluorescence from a contained phosphor coating on the interior of the lamp. The electron source is generally a metal coil, usually tungsten, containing an electron emissive material. Two such coils are provided, one at either end of an elongated glass tube. During operation of the lamp it is not unusual for sublimation or sputtered products from the coils to plate out on the inside surface of the lamp adjacent the coils, causing undesired darkening of the glass and reduced light output.

To remedy this situation shields have been placed around the coils to catch the sublimation or sputtered products, which generally comprise tungsten, iron and nickel. Such shields, however, add to the cost and make assembly of the mount structure into the lamp envelope difficult since such shields, in the past, have substantially surrounded the coil, extending beyond a desirable perimeter. Further, the shields have been occasionally mounted to one or both of the lead-in wires for the electrode coil raising the possibility of short circuiting the coil in the event of misalignment In those instances wherein two separate shields have been mounted, one on each lead-in wire, the shields also function as an anode during one half of the cycle. Such shields, also, complicate the mounting and can lead to excess heating of the coil.

DISCLOSURE OF INVENTION

It is, therefore, an object of the invention to obviate the disadvantages of the prior art.

It is another object of the invention to enhance the operation of fluorescent lamps.

Yet another object of the invention is the enhancement of electrode coil shields.

These objects are accomplished, in one aspect of the invention, by the provision of a mount for a fluorescent lamp, which comprises a glass base, a longitudinal electrode coil mounted upon lead-in wires extending from the base, and a shield mounted upon the base. The shield comprises a pair of spaced apart shield plates, one on either side of the electrode coil and spaced therefrom. To avoid acting as an anode during half of the alternating current cycle, the shield plates are electrically isolated from the cathode. By electrically isolated is meant that the shields are not hard-wired into any part of the electrical circuit.

Use of these shield plates reduces the size of the shield and makes the insertion operation simpler and more accurate. Further, the shield plates do not act as an anode and thus allow for better controlled heating of the electrode coil.

BEST MODE FOR CARRYING OUT THE INVENTION

For a better understanding of the present invention, together with other and further objects, advantages and capabilities thereof reference is made to the following disclosure and appended claims in conjunction with the above-described drawings.

Figure 1:
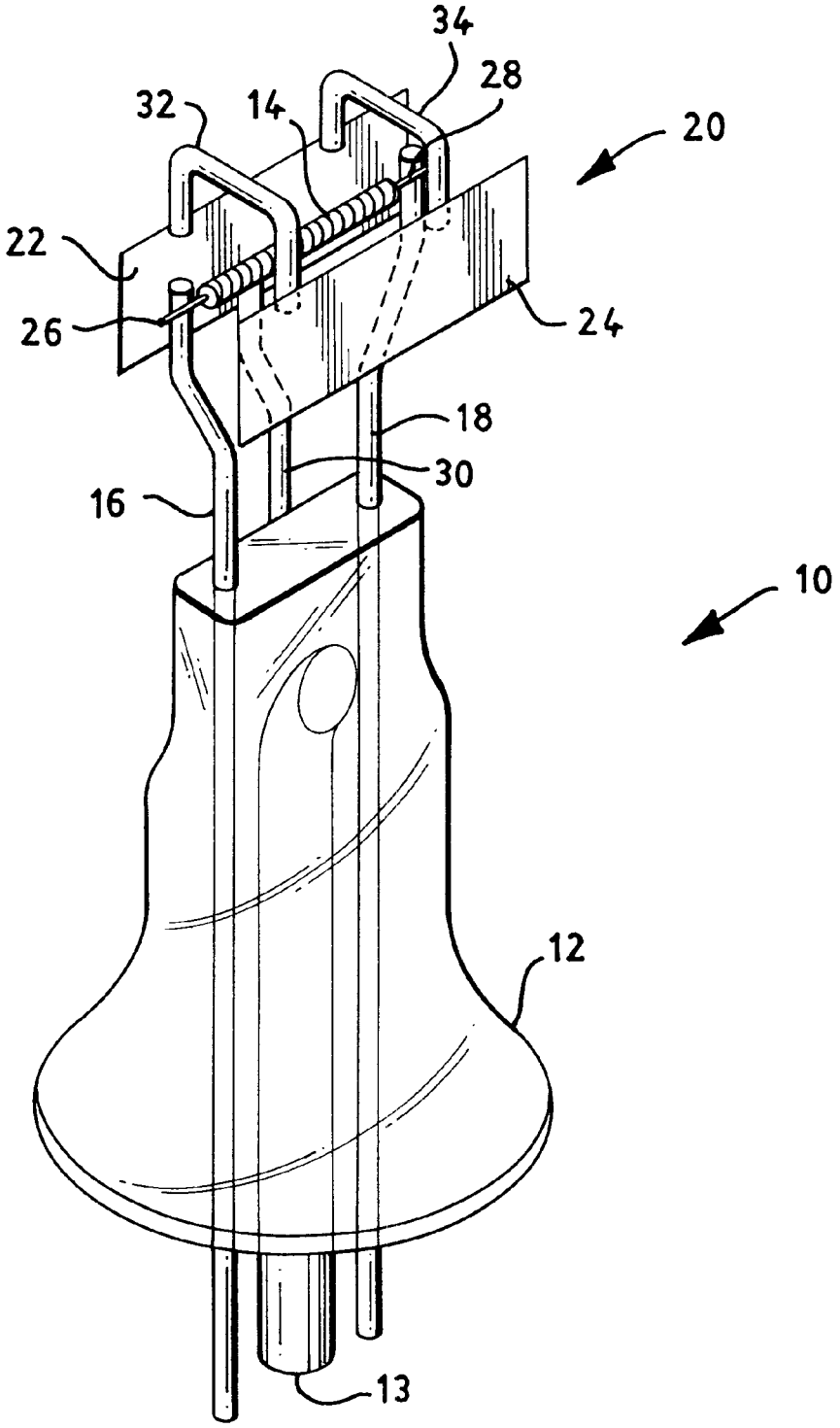
FIG. 1 is a perspective view of a fluorescent lamp mount employing the invention.
Figure 2:
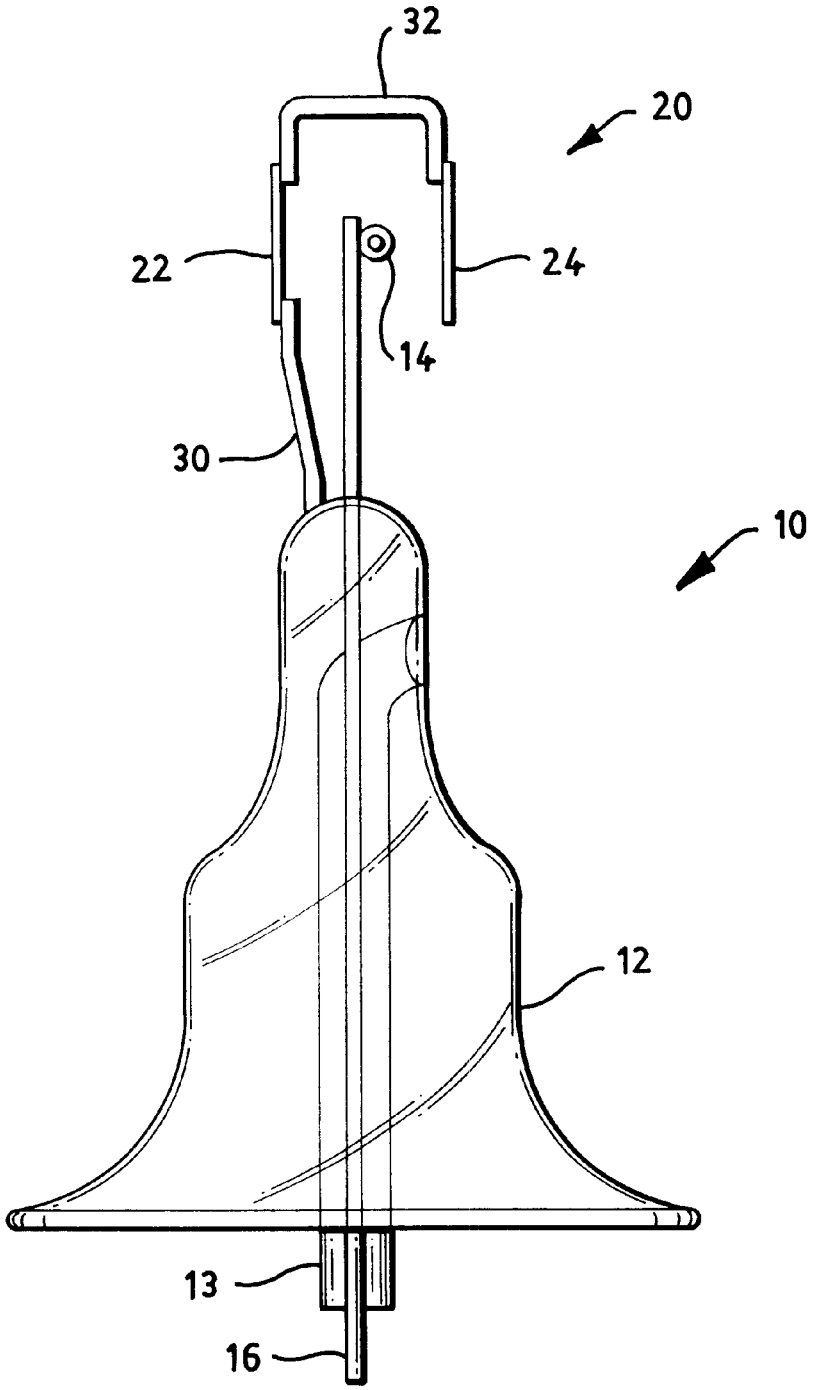
FIG. 2 is an elevational view of the mount.

Referring now to the drawings with greater particularity, there is shown in FIGS. 1 and 2 a mount 10 for a fluorescent lamp. The mount 10 has a glass base 12 and can include an exhaust tubulation 13. A longitudinal electrode coil 14 is affixed between lead-in wires 16 and 18 at junctions 26 and 28, as by welding.

A shield 20 is mounted upon the base 12 via attachment to a wire stud 30. The wire stud 30 is electrically isolated from the remainder of the circuit by being dead-ended in the glass base 12.

Figure 3:
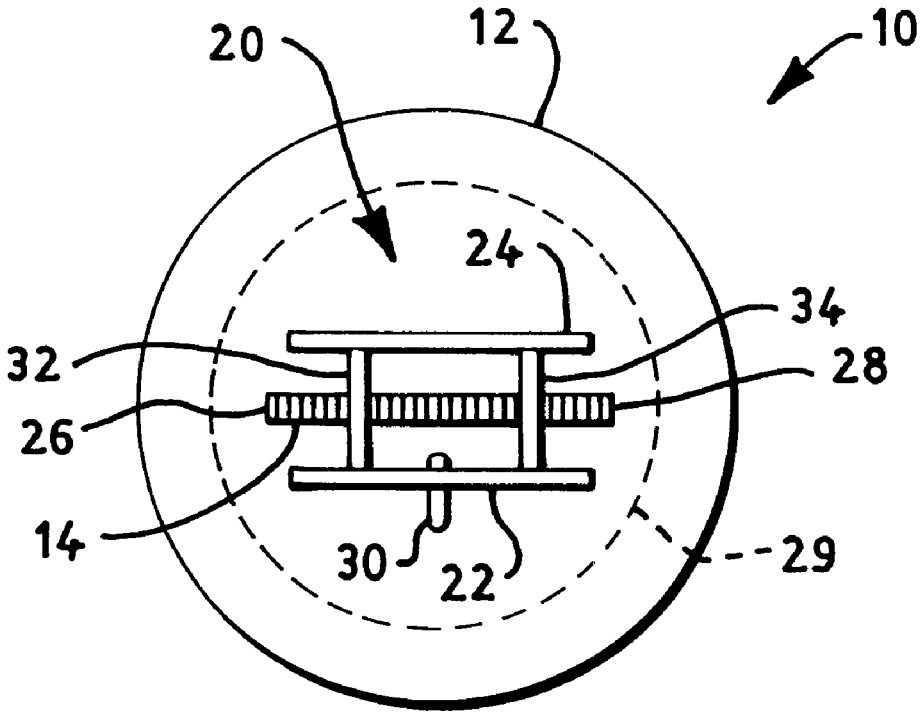
FIG. 3 is a diagrammatic plan view of the mount.

The shield 20 is comprised of two spaced-apart shield plates 22 and 24, positioned one on either side of the electrode coil 14. Shield plates 22 and 24 extend for a longitudinal length that is less than the length of the electrode coil 14 and do not cover the junctions 26 and 28, which can be seen more clearly in FIG. 3. Also seen more clearly in FIG. 3 is that the shield 20 fits within the inner wall 29 of the tube collar, represented by the inner diameter of the lamp envelope and shown as a dotted line in FIG. 3. This feature ensures easy and consistent assembly of the mount 10 within a lamp envelope.

The shield plates 22 and 24 are mounted and spaced apart by U-shaped connectors 32 and 34, thus forming a shield assembly. Only one of the shield plates, for example 22, is attached to the wire stud 30. This arrangement electrically isolates the shield from the electrode coil.

Tests of this mount with the spaced-apart shield plates showed ease of assembly and no deposition of dark areas on the inner lamp wall. This is a surprising result because of the lack of coverage of the junctions 26 and 28.

In a preferred embodiment of the invention the shield plates 22 and 24 are formed of nickel-plated steel; however, if expense is a concern, steel strips may be used.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mount for a fluorescent lamp comprising:

a glass base;

a longitudinal electrode coil mounted upon lead-in wires extending from said base; and a shield assembly fixed to a wire stud mounted in said base, said shield assembly comprising a pair of spaced apart shield plates, one on either side of said electrode coil and spaced therefrom, said wire stud is directly affixed to only one of said shield plates, and shield plates being electrically isolated from said electrode coil.

2. The mount of claim 1 wherein said electrode coil is attached to said lead-in wires at a junction and said junction is not covered by said shield.

3. The mount of claim 1 wherein the other of said shield plates is affixed to said one of said shield plates by a pair of U-shaped connectors.

4. The mount of claim 3 wherein said pair of U-shaped connectors extends over said electrode coil in an area remote from said base.

* * * * *